US008252384B2

(12) United States Patent
Jensen et al.

(10) Patent No.: US 8,252,384 B2
(45) Date of Patent: Aug. 28, 2012

(54) METHOD FOR FEEDING PARTICLES OF A COATING MATERIAL INTO A THERMAL SPRAYING PROCESS

(75) Inventors: Jens Dahl Jensen, Berlin (DE); Jens Klingemann, Berlin (DE); Ursus Krüger, Berlin (DE); Daniel Körtvelyessy, Berlin (DE); Volkmar Lüthen, Berlin (DE); Ralph Reiche, Berlin (DE); Oliver Stier, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 392 days.

(21) Appl. No.: 12/443,595

(22) PCT Filed: Sep. 27, 2007

(86) PCT No.: PCT/EP2007/060250

§ 371 (c)(1),
(2), (4) Date: Nov. 11, 2009

(87) PCT Pub. No.: WO2008/037761

PCT Pub. Date: Apr. 3, 2008

(65) Prior Publication Data

US 2010/0098845 A1 Apr. 22, 2010

(30) Foreign Application Priority Data

Sep. 28, 2006 (DE) ..... 10 2006 047 101

(51) Int. Cl.
*B05D 1/06* (2006.01)
*B05D 1/10* (2006.01)

(52) U.S. Cl. ..... 427/422; 427/189; 427/421.1; 427/446

(58) Field of Classification Search ..... 427/446, 427/189, 422, 421.1
See application file for complete search history.

(56) References Cited

U.S. PATENT DOCUMENTS

| | | | | |
|---|---|---|---|---|
| 5,833,891 | A * | 11/1998 | Subramaniam et al. | 264/7 |
| 6,491,967 | B1 | 12/2002 | Corderman | |
| 6,579,573 | B2 | 6/2003 | Boland | |
| 6,715,640 | B2 | 4/2004 | Gabel | |

FOREIGN PATENT DOCUMENTS

| | | | |
|---|---|---|---|
| DE | 19747386 | A1 | 4/1999 |
| DE | 10392691 | T5 | 9/2005 |
| EP | 1134302 | A1 | 9/2001 |
| WO | WO 9606957 | A1 | 3/1996 |
| WO | WO 2005061116 | A1 | 7/2005 |

* cited by examiner

OTHER PUBLICATIONS

Andreas Killinger, Melanie Kuhn, Rainer Gadow; "High-Velocity Suspension Flame Spraying (HVSFS), a new approach for spraying nanoparticles with hypersonic speed"; Surface & Coatings Technology 201 (2006), Seiten 1922-1929; Stuttgart; Others; DE.

*Primary Examiner* — Frederick Parker
(74) *Attorney, Agent, or Firm* — King & Spalding L.L.P.

(57) ABSTRACT

In a method particles in a thermal spraying process are entrained by a carrier gas stream and deposited on a component to be coated. The particles are dispersed in a liquid or solid additive before being introduced into a supply line which issues into the thermal spraying apparatus, the additive, after leaving the supply line, being transferred into the gaseous state in the carrier gas stream. A liquid additive evaporates or a solid additive is sublimated, whereby the particles in the carrier gas stream are separated. The dispersal of the particles in the additive simplifies an exact metering and prevents the particles from forming lumps, so that improved layers can be deposited by virtue of an improved homogeneity of the carrier gas stream. As the additive has been transferred into the gaseous state, it is not deposited in the layer.

10 Claims, 1 Drawing Sheet

METHOD FOR FEEDING PARTICLES OF A COATING MATERIAL INTO A THERMAL SPRAYING PROCESS

CROSS-REFERENCE TO RELATED APPLICATIONS

This application is a United States national phase filing under 35 U.S.C. §371 of International Application No. PCT/EP2007/060250, filed Sep. 27, 2007 which claims priority to German Patent Application No. 10 2006 047 101.6, filed Sep. 28, 2006. The complete disclosure of the above-identified application is hereby fully incorporated herein by reference.

TECHNICAL FIELD

The invention relates to a method for the injection of particles of a layer material into a cold-gas spraying process, in which the particles are conducted through a supply line and are delivered to a carrier gas stream via the mouth of the supply line, the carrier gas stream serving for transporting the particles to a component surface to be coated. For this purpose, the carrier gas stream is conducted through a stagnation chamber, into which the supply line also issues, and is subsequently accelerated through a nozzle onto the surface to be coated.

BACKGROUND

Thermal spraying processes are generally used in order to generate cost-effective layers of components to be coated or to provide these with properties which cannot otherwise be generated. For this purpose, the layer material has to be fed into the spraying process, this usually taking the form of particles. These particles are conducted through a supply line which they leave through a mouth in order to be picked up by a carrier gas stream which, for coating purposes, is directed onto the component to be coated. So that the particles adhere to the component to be coated, these must have imparted to them an energy amount which is dependent on the coating method and material and which causes the particles to adhere to the component to be coated. This introduction of energy may take place, for example, by heating the particles during spraying or else by accelerating the particles. In cold-gas spraying, however, the kinetic energy introduced into the process as a result of acceleration is converted into deformation or heat when the particles impinge on the component to be coated. If there is a sufficient introduction of energy, heating of the particles leads to a softening or even a melting of the particles, thus facilitating an adhesion of the particles impinging onto the component to be coated.

In cold-gas spraying, an introduction of energy in the form of kinetic energy is adopted primarily, although an additional heating of the particles may take place, but this does not usually cause a fusion or melting of the particles. On account of the high kinetic energy of the particles, these experience plastic deformation when they impinge onto the surface to be coated, a simultaneous deformation of the surface causing an adhesion of the particles. Furthermore, for example, high-velocity flame spraying makes available a thermal spraying method in which both the kinetic energy and the thermal energy of the particles impinging onto the surface to be coated play an appreciable part in layer formation. Cold-gas spraying is mentioned, for example in DE 197 47 386 A1.

To achieve a high-quality coating result, it is particularly important that the particles provided for coating can be delivered to the carrier gas stream in a clearly defined way. In order to ensure this, in particular, an agglomeration of the particles must be suppressed, so that these can be fed into the carrier gas stream as uniformly as possible and not as large clusters. As may be gathered from U.S. Pat. No. 6,715,640 B2, an agglomeration of the coating particles can be reduced or canceled, for example, by mechanical means. The particles are in this case stored in a funnel-shaped container and are extracted from this in the quantity required in each case. The extracted quantity can be treated by vibration and agitation in such a way that a separation of the particles takes place and these can be delivered to a transport gas. This gives rise to a particle/gas mixture which can be delivered to the carrier gas stream of a thermal spraying process through a supply line.

A. Killinger et al, "High-Velocity Suspension Flame Spraying (HVSFS), a new approach for spraying nanoparticles with hypersonic speed", Surface & Coatings Technology 201 (2006) 1922-1929, and U.S. Pat. No. 6,579,573 B2, U.S. Pat. No. 6,491,967 B1, EP 1 134 302 A1 and DE 103 92 691 T5 disclose thermal coating methods in which the introduction of energy into the jet containing the coating particles takes place by means of a flame, such as, for example, a plasma flame. In this flame spraying coating method, the adhesion of the coating particles on the substrate to be coated is ensured by means of the flame as an energy source with a relatively high energy density. This energy source is in the form of a flame in the center of a coating nozzle, so that coating particles in the form of a liquid dispersion can be delivered directly to the flame. The high energy density of the flame in this case ensures a complete evaporation of the dispersant, while the energy amount necessary for evaporation can be made available by suitably regulating the energy supply for the flame. The flame, because of the high energy density, can readily make available the energy amount necessary for the evaporation of the dispersant.

SUMMARY

According to various embodiments, a method for the feed of particles into a cold-gas spraying process can be specified, by means of which the thermal spraying process can be carried out with comparatively uniform layer results.

According to an embodiment, in a method for the feed of particles of a layer material into a cold-gas spraying process, the particles can be conducted through a supply line and can be delivered to a carrier gas stream via the mouth of the supply line, the carrier gas stream serving for transporting the particles to a surface, to be coated, of a component and, for this purpose, being routed through a stagnation chamber and subsequently accelerated through a nozzle, wherein the particles, before being introduced into the supply line, may be dispersed in a liquid or solid additive, the additive being selected such that, after leaving the mouth of the supply line, it assumes a gaseous state in the case of the temperature reduction and pressure reduction in the carrier gas stream which occur on account of the adiabatic expansion of the carrier gas.

According to a further embodiment, the carrier gas stream, before being delivered to the nozzle, can be heated in such a way that a condensation and solidification and/or resublimation of the additive are prevented. According to a further embodiment, the carrier gas stream can be heated in the stagnation chamber. According to a further embodiment, to obtain the additive, an initial material gaseous at room temperature and atmospheric pressure may be solidified or liquefied by means of a pressure rise and/or cooling. According to a further embodiment, water can be used as an additive. According to a further embodiment, a suspension can be produced from the liquid additive and the particles by agitation and can be stored. According to a further embodiment, the metering of the particles for the spraying process may take place, taking into account the particle concentration in the suspension, by setting the volume flow in the supply line. According to a further embodiment, the solid additive in which the particles are distributed dispersedly may be processed into a powder by means of conditioning, in particular grinding or atomization. According to a further embodiment, the powder may be added, metered, to a gas stream conducted through the supply line.

BRIEF DESCRIPTION OF THE DRAWINGS

Further details of the invention are described below with reference to the drawings. Identical or mutually corresponding elements in the individual figures are in each case given the same reference symbols and are explained more than once only insofar as differences between the individual figures arise.

In these.

DETAILED DESCRIPTION

Figure 1:
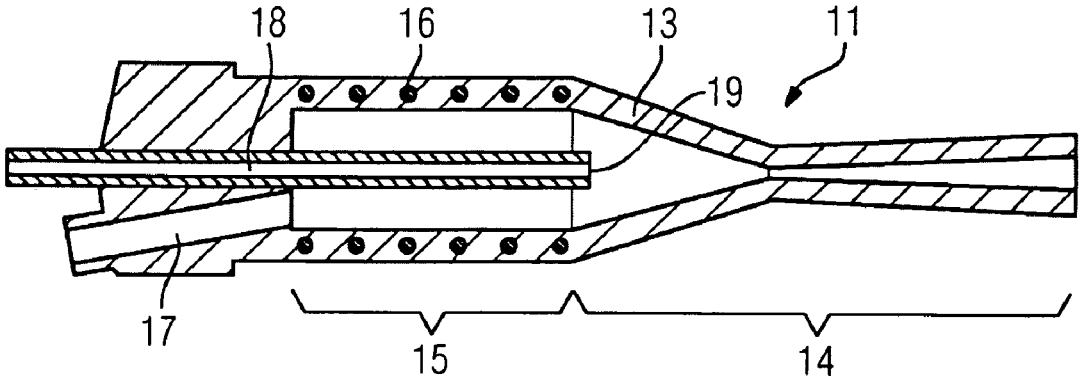
FIG. 1 shows a cold-gas spray gun which is suitable for an exemplary embodiment of the method, in longitudinal section.

According to various embodiments, and by means of the method initially specified, the particles are dispersed before being introduced into the supply line, the additive, after leaving the mouth of the supply line, being transferred into the gaseous state in the carrier gas stream. Accordingly, therefore, there is provision for the particles of the layer material not to be transported or handled as pure powder, but for the particles to be distributed finely in a liquid or solid additive. This additive has the advantage that it can be handled as such more easily than the particles which take the form of a dry powder. Simpler and, in particular, also more accurate metering can thereby advantageously take place, so that a method for feeding these particles can benefit from this. However, since the thermal spraying process requires that the particles in the carrier gas stream are in the pure state again at the latest when they reach the component surface, according to various embodiments, there is provision, furthermore, for the additive, after leaving the mouth of the supply line, to assume a gaseous state in the carrier gas stream. What is advantageously achieved thereby is that the material of the additive does not form a particulate or drop-shaped phase, but only contributes partial pressure to the carrier gas. By the additive being transferred into the gaseous state, that is to say by the evaporation of a liquid additive or by the sublimation or melting and evaporation of a solid additive, therefore, the separation of the particles in the carrier gas stream from the additive is brought about. Advantageously, on the other hand, the solid or liquid additive prevents the particles from forming lumps during transport to the supply line.

Advantageously, the carrier gas stream is routed through a stagnation chamber and is subsequently accelerated through a nozzle. This procedure for the thermal spraying process is necessary, in particular, when the spraying process is to take place with the introduction of an appreciable amount of kinetic energy into the particles, as is required in the already mentioned method of high-velocity flame spraying and cold-gas spraying. Since the carrier gas stream is routed beforehand through a stagnation chamber, the dwell time of the molecules of the carrier gas stream in the thermal spraying apparatus can advantageously be increased. This facilitates the supply of thermal energy, this preferably being transmitted during the dwell time of the molecules of the carrier gas stream in the stagnation chamber. What is to be understood in this context as being a stagnation chamber is a line structure, widened in cross section in comparison with the nozzle, for the carrier gas stream. However, the cross-sectional widening does not bring about stagnation in the narrower sense, but merely reduces the flow velocity of the carrier gas stream, so that the dwell time of the gas molecules in the stagnation chamber is increased in comparison with the nozzle.

The transmission of heat energy into the stagnation chamber may take place by means of all known energy sources. For example, the wall of the stagnation chamber may be heated, so that the thermal energy is radiated into the interior of the stagnation chamber, or is transmitted to gas molecules of the carrier gas stream which buffer the wall. Furthermore, it is possible to carry out an introduction of energy into the volume of the stagnation chamber. This may take place, for example, by the ignition of an arc inside the stagnation chamber, by electromagnetic induction or by laser radiation. Furthermore, it is also possible to heat the nozzle as well as the stagnation chamber. The introduction of energy into the thermal spraying apparatus is necessary so that a transfer of the additive into the gaseous state takes place. To be precise, this must absorb thermal energy in order to change its state of aggregation.

According to an embodiment, there is provision for the carrier gas stream to be heated before delivery to the nozzle in such a way that a condensation (and therefore also solidification) and/or resublimation of the additive, in particular in the nozzle, are/is prevented. In dimensioning the heat quantity supplied to the carrier gas stream, it must be remembered that, due to the approximately adiabatic expansion of the carrier gas downstream of the nozzle throat, a sharp cooling of said carrier gas takes place. This cooling may in extreme cases even cause a resublimation or a condensation and solidification of the additive. New particles or droplets from the additive may thereby be formed which, together with the particles provided for deposition, impinge onto the surface to be coated. The additive may lead here to an unwanted contamination of the layer. If, however, sufficient heating of the carrier gas occurs, the molecules of the additive mixed with this remain in the gaseous state, therefore they cannot or can only in a negligible quantity be deposited in the layer which is being formed.

In general, the most critical conditions with regard to a resublimation or a condensation or solidification of the additive prevail near the nozzle outlet of the thermal spraying apparatus, since, in addition to a vacuum with respect to the surroundings, a temperature minimum of the carrier gas stream also occurs there. Ultimately, however, for dimensioning the at least necessary heating of the carrier gas stream, the state of the carrier gas stream when it impinges onto the component to be coated is critical, not the state in the nozzle.

Under specific preconditions, it may even be desirable for a resublimation or condensation or solidification of the additive to take place. In this case, the additive consists of a material which is to be deposited in the layer being formed and, where appropriate, is to react with the deposited particles. The energy which may possibly be necessary for this purpose is likewise obtained from the thermal energy supplied to the carrier gas stream.

In the choice of the additive, account must be taken of the fact that this should not cause any explosive exothermal reactions in the carrier gas stream. This would be the case particularly if sublimation or evaporation were to give rise to a gas mixture with a carrier gas which contained oxygen and an easily oxidizable, that is to say a fire-risk, substance. In this case, it is unimportant which of these substances is contributed by the carrier gas and which of the substances is contributed by the additive. The heating and pressure rise upstream of the nozzle outlet would, in the presence of an explosive gas mixture, quickly lead to uncontrollable explosive phenomena. On the other hand, however, a controllable reaction in the carrier gas stream could make additional energy available for coating, or, in the case of a reaction with the particles provided for coating, could also directly influence in a desirable way the chemical composition of the coating to be formed.

According to an embodiment, to obtain the additive, an initial material gaseous at room temperature and atmospheric pressure is solidified or liquefied by a pressure rise and/or cooling. An additive obtained in this way has the advantage that it becomes gaseous again under normal conditions, such as normally prevail outside the thermal spraying apparatus. Consequently, an additive of this type, when it emerges from the nozzle orifice of the thermal spraying apparatus, can advantageously also be transferred particularly simply into a gaseous state.

However, temperatures lying above the standard conditions prevail in the thermal spraying apparatus. Therefore, according to another embodiment, water may also be used as additive. The precondition for this, however, is that the temperature at the nozzle outlet at least does not appreciably undershoot a temperature of 100° C., since a formation of water droplets could not be prevented in this case. The use of water as additive has the advantage, in particular, that this liquid is chemically relatively stable at a relatively low boiling point and therefore a reaction with most particle types provided for coating is absent. Moreover, even when it emerges into the surroundings, water can be judged as presenting no problems in terms of its environmental compatibility.

In the event that the additive is used in the liquid state, it is advantageous by agitation to produce a suspension and store this. This suspension can then be fed into the supply line, while technology already proven in the conduction of liquids can be adopted for metering the particles. As a result, the suspended particles can advantageously be metered in a simple way by handling the additive. The metering of the particles for the spraying process may take place, in particular, taking into account the particle concentration in the suspension, by setting the volume flow in the supply line. In this case, it is of great importance that the concentration of particles is kept constant by the agitation or movement of the suspension, so that the latter can be fed in a known volume flow directly into the supply line.

If a solid additive is used, it is advantageous to distribute the particles dispersedly in this and to carry out conditioning, in particular grinding or atomization, with the result that the solid additive is processed into a powder. This gives rise to a powder which is generally coarser-grained than the particles themselves and which, by virtue of its properties, is easier to route and to meter than the particles themselves. Since the additive is not to be deposited in the layer to be formed, the layer-forming process itself does not have to be taken into consideration in the choice of the additive. Consequently, for conduction and metering, optimized additives can be selected which compensate possible metering problems with regard to the particles provided for coating. The powder can therefore easily be added, metered, to a gas stream conducted to the supply line, while metering can be selected, taking into account the layer-forming process in thermal spraying.

Producing a suspension or a powder with finely distributed particles for coating has the advantage that, in addition to a greater diversity of particle materials, finer particles can also be used. These, if added directly to a gas stream, would no longer be transportable without forming lumps. However, assistance by a liquid or solid additive simplifies transporting the supply line and therefore also metering into the thermal spraying process.

Figure 2:
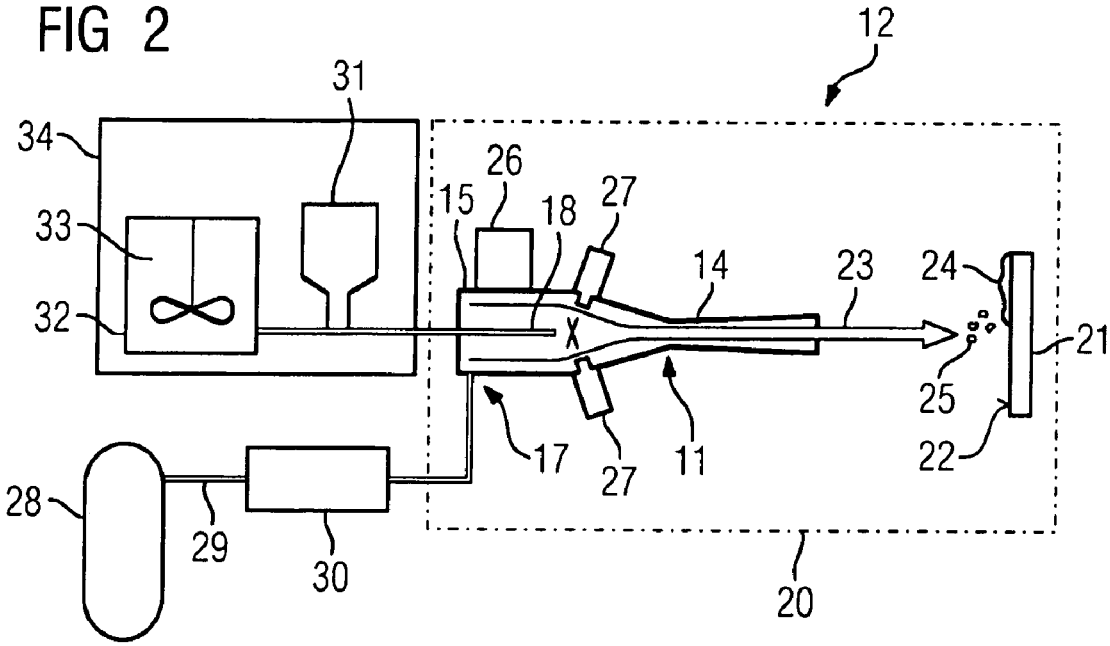
FIG. 2 shows diagrammatically a thermal spraying apparatus which is suitable for carrying out the method, as a block diagram.

A cold-gas spray gun 11 according to FIG. 1 constitutes the core of a thermal spraying apparatus 12 according to FIG. 2. The cold-gas spray gun 11 according to FIG. 1 consists essentially of a Laval nozzle 14 and a stagnation chamber 15 which are formed in a single housing 13. In the region of the stagnation chamber 15, a heating coil 16 is embedded into the wall of the housing 13 and causes the heating of a carrier gas which is supplied via an inlet 17 of the stagnation chamber 15.

The carrier gas passes through the inlet 17 first into the stagnation chamber 15 and leaves the latter through the Laval nozzle 14. In this case, the carrier gas may be heated in the stagnation chamber to 800° C. For example, a liquid additive having the particles provided for coating is fed in through a supply line 18, the mouth 19 of which is arranged in the stagnation chamber 15 and a Laval nozzle 14. As a result of an expansion of the carrier gas stream, acted upon by the particles and the additive, through the Laval nozzle 14, a cooling of the carrier gas stream is brought about, the latter having temperatures of below 300° C. in the region of the nozzle orifice. This temperature reduction is attributable to a substantially adiabatic expansion of the carrier gas which in the stagnation chamber has, for example, a pressure of 30 bar and outside the nozzle orifice is expanded to atmospheric pressure.

FIG. 2 illustrates diagrammatically how a cold spray gun 11 according to FIG. 1 could be completed into a thermal spraying apparatus 12. The thermal spray gun 11 is arranged in a housing space 20, not illustrated in any more detail, in which may also be arranged a component 21 to be coated which points with a surface 22 to be coated toward the nozzle orifice of the cold spray gun 11. Furthermore, the carrier gas stream 23 is indicated by an arrow, and it becomes clear that the carrier gas stream is aligned with the surface 22 and impinges there so as to form a layer 24 which is formed from the particles 25 located in the carrier gas stream. Instead of a heating coil 16 according to FIG. 1, various energy sources for the supply of heat are arranged on the cold spray gun 11. A microwave generator 26 is suitable for heating by electromagnetic induction the carrier gas located in the stagnation chamber 15 and also the particles and the additive. Furthermore, two lasers 27 are mounted on the cold spray gun and radiate a laser beam into the interior of the stagnation chamber 15, these lasers intercepting exactly in front of the mouth of the supply line 18. A directed introduction of energy into the additive provided with the particles is thereby possible, this energy being absorbed via the transfer of the additive into the gaseous state, and the thermal load on the particles 25 consequently being limited.

Furthermore, a reservoir 28 is provided for the carrier gas used which can be delivered via a line 29 to a preheating unit 30 and subsequently to the inlet 17 to the stagnation chamber 15. It is possible to regulate the gas stream via throttle valves, not illustrated.

Furthermore, reservoirs which can be charged up alternately are provided for the particles. A supply funnel 31 may contain a suitably conditioned powder of an additive, in the powder particles of which the particles provided for coating are distributed finely dispersedly. The powder is conditioned in such a way that delivery into the supply line 18 can take place without difficulty. In this case, a gas stream is conducted through the supply line and has the powder particles added to it. Furthermore, a storage tank 32 is provided, in which a suspension consisting of a liquid additive and of particles for coating which are dispersed therein can be stored. In said storage tank, an agitator device 33 is provided, which ensures the homogeneity of the dispersion. The supply funnel 31 and the storage tank 32 are surrounded by a thermal insulation 34, thus allowing the efficient use of cooled additives, for example substances which are gaseous at room temperature.

The invention claimed is:

1. A method for the feed of particles in a thermal spraying apparatus that employs a cold-gas spray gun comprising:

conducting the particles through a supply line and delivering the particles to a carrier gas stream via the mouth of the supply line, the carrier gas stream serving for transporting the particles to a surface of a component to be coated;

wherein the particles are routed through a stagnation chamber of the cold-gas spray gun and subsequently accelerated through a nozzle of the cold-gas spray gun to disperse the particles, wherein a liquid or solid additive is provided to the particles before the particles are introduced into the supply line, the additive being selected such that, after leaving the mouth of the supply line, the additive assumes a gaseous state due to a temperature reduction and pressure reduction in the carrier gas stream caused by adiabatic expansion of the carrier gas.

2. The method according to claim 1, wherein the carrier gas stream, before being delivered to the nozzle, is heated in such a way that at least one of a condensation and solidification, and resublimation of the additive are prevented.

3. The method according to claim), wherein the carrier gas stream is heated in the stagnation chamber.

4. The method according to claim 1, wherein, to obtain the additive, an initial material which is gaseous at room temperature and atmospheric pressure is solidified or liquefied by means of at least one of a pressure rise and cooling.

5. The method according to claim 1, wherein water is used as an additive.

6. The method according to claim 1, wherein a suspension is produced from the liquid additive and the particles by agitation and is stored prior to introduction into the supply line.

7. The method according to claim 6, wherein the metering of the particles for the spraying process takes place, taking into account the particle concentration in the suspension, by setting the volume flow in the supply line.

8. The method according to claim 1, wherein the solid additive in which the particles are distributed dispersedly is processed into a powder.

9. The method according to claim 8, wherein the powder is added to a gas stream conducted through the supply line.

10. The method according to claim 1, wherein the solid additive in which the particles are distributed dispersedly is processed into a powder by means of grinding or atomization.

* * * * *